US005437909A

United States Patent [19]

Herzberg

[11] Patent Number: 5,437,909

[45] Date of Patent: Aug. 1, 1995

[54] MULTILAYER NONWOVEN THERMAL INSULATING BATTS

[75] Inventor: Carol E. Herzberg, Afton, Minn.

[73] Assignee: Minnesota Mining and Manufacturing Company, St. Paul, Minn.

[21] Appl. No.: 247,133

[22] Filed: May 20, 1994

[51] Int. Cl.[6] ..... B32B 5/06

[52] U.S. Cl. ..... 428/192; 428/193; 428/194; 428/196; 428/198; 428/288; 428/296

[58] Field of Search ..... 428/296, 288, 192, 193, 428/194, 196, 198

[56] References Cited

U.S. PATENT DOCUMENTS

| | | | |
|---|---|---|---|
| Re. 30,955 | 6/1982 | Stanistreet | 156/308 |
| 3,905,057 | 9/1975 | Willis et al. | 5/337 |
| 4,068,036 | 1/1978 | Stanistreet | 428/296 |
| 4,118,531 | 10/1978 | Hauser | 428/224 |
| 4,128,678 | 12/1978 | Metcalfe et al. | 428/119 |
| 4,392,903 | 7/1983 | Endo et al. | 156/167 |
| 4,481,256 | 11/1984 | Masuda et al. | 428/362 |
| 4,588,635 | 5/1986 | Donovan | 428/288 |
| 4,837,067 | 6/1989 | Carey, Jr. et al. | 428/108 |
| 4,950,541 | 8/1990 | Tabor et al. | 428/373 |
| 4,992,327 | 2/1991 | Donovan et al. | 428/296 |
| 5,114,787 | 5/1992 | Chaplin et al. | 428/284 |
| 5,141,805 | 8/1992 | Nohara et al. | 428/296 |
| 5,256,050 | 10/1993 | Davies | 425/131 |

*Primary Examiner*—Patrick J. Ryan
*Assistant Examiner*—Richard P. Weisberger
*Attorney, Agent, or Firm*—Gary L. Griswold; Walter N. Kirn; Carole Truesdale

[57] ABSTRACT

A multilayer nonwoven thermal insulating batt is provided. The batt comprises multiple layers of webs, each web being a blend of 5 to 100 weight percent bonding staple fibers and 0 to 95 weight percent staple fill fibers, the bonding fibers bonded to other bonding fibers and fill fibers at the points of contact to enhance the structural stability of the layers of the batt. Also provided is a method of making the thermal insulating nonwoven multilayer batt comprising the steps of: (a) forming a web of bonding staple fibers and staple fill fibers; (b) subjecting the web to sufficient heat to cause bonding of the bonding staple fibers to other bonding staple fibers and staple fill fibers at points of contact within the web to stabilize the web; and (c) forming a batt of multiple layers of said webs.

6 Claims, 1 Drawing Sheet

MULTILAYER NONWOVEN THERMAL INSULATING BATTS

FIELD OF THE INVENTION

The present invention relates to improved insulating and cushioning structures made from synthetic fibrous materials and more particularly to thermal insulating materials having the insulating performance, conformability and feel of down.

BACKGROUND OF THE INVENTION

A wide variety of natural and synthetic filling materials for thermal insulation applications, such as outerwear apparel, e.g. jackets, stocking caps, and gloves, sleeping bags and bedding articles, e.g., pillows, comforters, quilts, and bedspreads, are known.

Natural feather down has found wide acceptance for thermal insulation applications, primarily because of its outstanding weight efficiency, softness, and resiliency. Properly fluffed and contained within an article or garment, down is generally recognized as the insulation material of choice. However, down compacts and loses its insulating properties when it becomes wet and can exhibit a rather unpleasant odor when exposed to moisture. Also a carefully controlled cleaning and drying process is required to restore the fluffiness and resultant thermal insulating properties to an article in which the down has compacted.

There have been numerous attempts to prepare synthetic fiber-based structures having the characteristics and structure of down. Several attempts have been made to produce substitutes for down by converting the synthetic fibrous materials into insulating batts configured to have fibers that have specific orientations relative to the faces of the batt followed by bonding of the fibers to stabilize the web to afford improved insulating properties.

Such attempts include a pillow formed of an assemblage of generally co-planar fibers encased in a casing, where the fibers are substantially perpendicular to the major axis of the elliptical cross-section of the pillow surfaces to provide a degree of resiliency and fluffability; a thermal insulating material which is a web of blended microfibers with crimped bulking fibers which are randomly and thoroughly intermixed and intertangled with the microfibers to provide high thermal resistance per unit thickness and moderate weight; and a nonwoven thermal insulating batt of entangled staple fibers and bonding staple fibers which are substantially parallel to the faces of the web at the face portions of the web and substantially perpendicular to the faces of the batt in the central portion of the batt with the bonding staple fibers bonded to the structural staple fibers and other bonding staple fibers at points of contact.

Other structures include a blend of 80 to 90 weight percent of spun and drawn, crimped staple synthetic polymeric microfibers having a diameter of 3 to 12 microns and 5 to 20 weight percent of synthetic polymeric staple macrofibers having a diameter of from more than 12 up to 50 microns which is described as comparing favorably to down in thermal insulating properties and a synthetic fiber thermal insulating material in the form of a cohesive fiber structure of an assemblage of from 70 to 95 weight percent of synthetic polymeric microfibers having diameter of from 3 to 12 microns and from 5 to 30 weight percent of synthetic polymeric macrofibers having a diameter of 12 to 50 microns where at least some of the fibers are bonded at their contact points, the bonding being such that the density of the resultant structure is within the range of 3 to 16 kg/m$^3$, the thermal insulating properties of the bonded assemblage being equal to or not substantially less than the thermal insulating properties of the unbonded assemblage. In this assemblage the entire assemblage is bonded together to maintain support and strength to the fine fibers without suffering from the lower thermal capacity of the macrofiber component.

A still further structure suggested for providing a resilient, thermally bonded non-woven fibrous batt includes having uniform compression modulus in one plane which is more than the compression modulus measured in a direction perpendicular to that plane and a substantially uniform density across its thickness. The batt is prepared by forming a batt comprising at least 20% by weight of crimped and/or crimpable conjugate fibers, i.e., bicomponent bonding fibers, having or capable of developing a crimp frequency of less than 10 crimps per extended cm, and a decitex in the range of 5 to 30. The batt is thermally bonded by subjecting it to an upward fluid flow heated to a temperature in excess of the softening component of the conjugate fiber to effect inter-fiber bonding.

BRIEF SUMMARY OF THE INVENTION

The present invention provides a nonwoven thermal insulating batt having multiple layers of webs, each web comprising a blend of bonding staple fibers and staple fill fibers, the bonding fibers bonded to other bonding fibers and to said staple fill fibers at points of contact to enhance the structural stability of each of the layers of the batt. The batt may contain staple fill fibers of two or more deniers. Preferably, the batt is post treated, such as by surface bonding, to stabilize the layered structure.

The present invention also provides a method of making a thermal insulating nonwoven multilayer batt comprising the steps of:

(a) forming a web of bonding staple fibers and staple fill fibers;

(b) subjecting said web to sufficient heat to cause bonding of the bonding staple fibers to other bonding staple fibers and staple fill fibers at points of contact to stabilize the web, and (c) forming a batt of multiple layers of said webs. Preferably, the web is formed by carding and the layering is achieved by cross-lapping the carded web. Further, the method preferably comprises post treating the batt, such as by surface bonding, to stabilize the layered structure.

The nonwoven thermal insulating batt of the present invention has thermal insulating properties, particularly thermal weight efficiencies, about comparable to or exceeding those of down, but without the moisture sensitivity of down. The presence of the individual layers of the multilayer batt increases the drapeability, softness of hand of the batt in conjunction with improved thermal insulating properties compared to batt compositions and constructions having single layer structures.

The mechanical properties of the batt of the present invention such as its density, resistance to compressive forces, loft as well as its thermal insulating properties can be varied over a significant range by changing the fiber denier, basis weight, structural to bonding fiber ratio, type of fibers, surface texture of the layer faces, and bonding conditions.

DETAILED DESCRIPTION OF THE INVENTION

Figure 1:
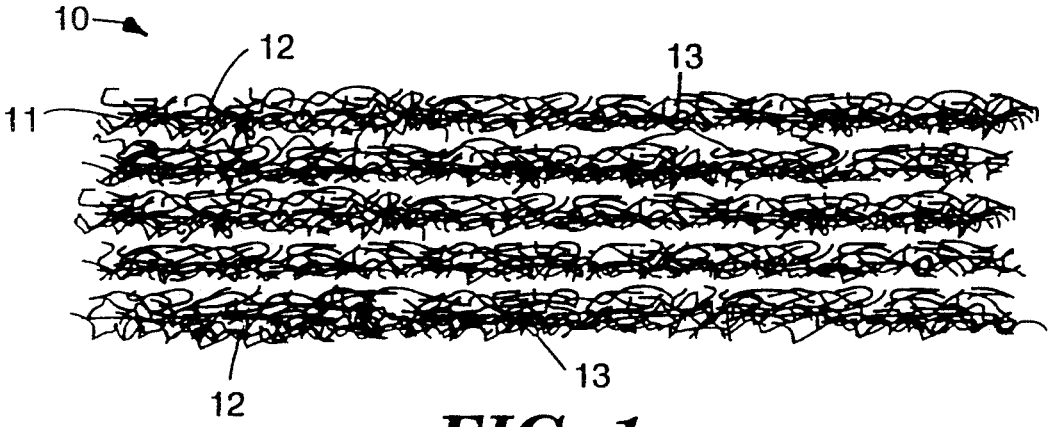
FIG. 1 is a representation of the multilayer nonwoven thermal insulating batt of the present invention.

The present invention, as shown in FIG. 1 is a nonwoven thermal insulating batt 10 comprised of layers 11 which contain staple fill fibers 12 and staple bonding fibers 13. The bonding fibers bond to other bonding fibers and fill fibers at points of contact within each layer such that the layers maintain their integrity.

Staple fill fibers, usually single component in nature, which are useful in the present invention include, but are not limited to, polyethylene terephthalate, polyamide, wool, polyvinyl chloride, acrylic and polyolefin, e.g., polypropylene. Both crimped and uncrimped structural fibers are useful in preparing the batts of the present invention, although crimped fibers, preferably having 1 to 10 crimps/cm, more preferably having 3 to 5 crimps/cm, are preferred.

The length of the structural fibers suitable for use in the batts of the present invention is preferably from 15 mm to about 50 mm, more preferably from about 25 mm to 50 mm, although structural fibers as long as 150 mm can be used.

The diameter of the staple fill fibers may be varied over a broad range. However, such variations alter the physical and thermal properties of the stabilized batt. Generally, finer denier fibers increase the thermal insulating properties of the batt, while larger denier fibers decrease the thermal insulating properties of the batt. Useful fiber deniers for the structural fibers preferably range from about 0.2 to 15 denier, more preferably from about 0.5 to 5 denier, most preferably 0.5 to 3 denier, with blends or mixtures of fiber deniers often times being employed to obtain desired thermal and mechanical properties as well as excellent hand of the stabilized batt. Finer denier staple fibers of up to about 4 denier provide improved thermal resistance, drape, softness and hand which show more enhancement as the denier is reduced. Larger denier fibers of greater than about 4 denier provide the batt with greater strength, cushioning and resilience with greater enhancement of these properties with increasing fiber denier.

A variety of bonding fibers are suitable for use in stabilizing the layers of the batts of the present invention, including amorphous, meltable fibers, adhesive coated fibers which may be discontinuously coated, and bicomponent bonding fibers which have an adhesive component and a supporting component arranged in a coextensive side-by-side, concentric sheath-core, or elliptical sheath-core configuration along the length of the fiber With the adhesive component forming at least a portion of the outer surface of the fiber. The adhesive component of the bondable fibers is preferably thermally bonded. The adhesive component of thermally bonding fibers must be thermally activatable (i.e., meltable) at a temperature below the melt temperature of the staple fill fibers of the batt.

A range of bonding fiber sizes, e.g. from about 0.5 to 15 denier are useful in the present invention, but optimum thermal insulation properties are realized if the bonding fibers are less than about four denier and preferably less than about two denier in size. As with the staple fill fibers, smaller denier bonding fibers increase the thermal insulating properties, while larger denier bonding fibers decrease the thermal insulating properties of the batt. As with the staple fill fibers, a blend of bonding fibers of two or more denier can also be used.

The length of the bonding fibers is preferably about 15 mm to 75 mm, more preferably about 25 mm to 50 mm, although fibers as long as 150 mm are useful. Preferably, the bonding fibers are crimped, having 1 to 10 crimps/cm, more preferably having 3 to 5 crimps/cm. Of course, adhesive powders and sprays can also be used to bond the staple fill fibers, although difficulties in obtaining even distribution throughout the web reduces their desirability.

One particularly useful bonding fiber for stabilizing the batts of the present invention is a crimped sheath-core bonding fiber having a core of crystalline polyethylene terephthalate surrounded by a sheath of an adhesive polymer of an activated copolyolefin. The sheath is heat softenable at a temperature lower than the core material. Such fibers, available from Hoechst Celanese Corporation, are particularly useful in preparing the batts of the present invention and are described in U.S. Pat. Nos. 5,256,050 and 4,950,541. Other sheath/core adhesive fibers may be used to improve the properties of the present invention. Representative examples include fibers having a higher modulus core to improve the resilience of the batt or fibers having sheaths with better solvent tolerance to improve dry cleanability of the batts.

The amounts of staple fill fiber and bonding staple fiber in the batts of the present invention can vary over a wide range. Generally, the amount of staple bonding fiber in the batt can range widely. Preferably, the batt contains 5 to 100 weight percent staple bonding fiber and 0 to 95 weight percent staple fill fiber, more preferably 10 to 80 weight percent staple bonding fiber and 20 to 90 weight percent staple fill fibers, most preferably 20 to 50 weight percent staple bonding fiber and 50 to 80 weight percent staple fill fiber.

The nonwoven thermal insulating batts of the invention are capable of proving thermal weight efficiencies of preferably at least about 20 clo/kg/m$^2$, more preferably at least 25 clo/kg/m$^2$ most preferably at least about 30 clo/kg/m$^2$ and radiation pammeters of less than about 20 (W/mK)(kg/m$^3$)(100), more preferably less than about 15 (W/mK)(kg/m$^3$)(100), more preferably less than 10 (W/mK)(kg/m$^3$)(100).

The nonwoven batts of the present invention preferably have a bulk density of less than about 0.1 g/cm$^3$, more preferably less than about 0.005 g/cm$^3$, most preferably less than about 0.003 g/cm$^3$. Effective thermal insulating properties are achievable with bulk densities as low as 0.001 g/cm$^3$ or less. To attain these bulk densities, the batts preferably have a thickness in the range of about 0.5 to 15 cm, more preferably 2 to 20 cm, most preferably 5 to 15 cm, and preferably have a basis weight from 20 to 600 g/m$^2$, more preferably 80 to 400 g/m$^2$, most preferably 100 to 300 g/m$^2$.

The webs which comprise the layers of the batt of the invention can be prepared using any conventional web forming process including carding, garnetting, air laying such as by Rando-Webber TM, etc. Carding is generally preferred. Each layer is preferably about 1 to 60 mm thick, more preferably 3 to 20 mm thick and preferably has a basis weight of about 5 to 300 g/m$^2$, more preferably about 5 to 100 g/m$^2$ and most preferably 10 to 30 g/m$^2$.

Thermal bonding may be carried out by any means which can achieve adequate bonding of the staple bonding fibers to provide adequate structural stability. Such means include, but are not limited to, conventional hot air ovens, microwave, or infrared energy sources.

The means of forming the layered batt is not critical. The layers may be formed by cross-lapping, layering multiple doffs, by ganging web formers or any other layering technique. The batts of the invention may contain up to about 100 layers, but generally contains about 5 to 30 layers and generally the effect can be seen with as few as two layers.

Figure 2:
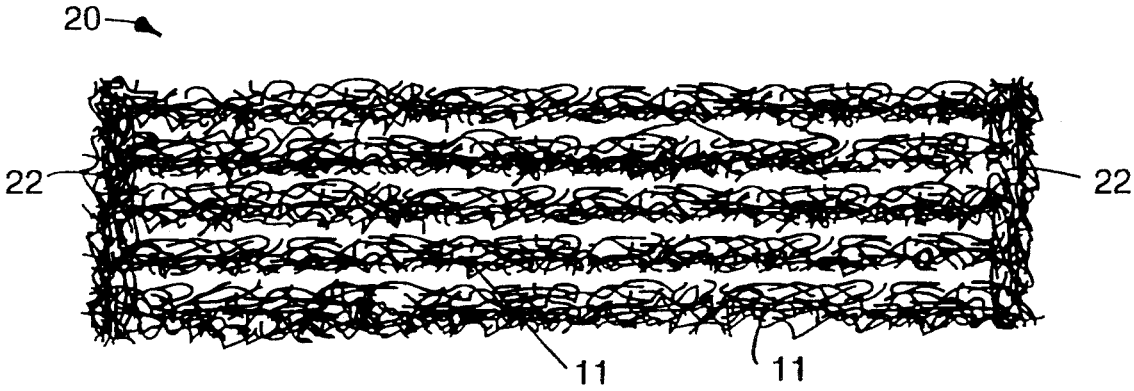
FIG. 2 is a cross-sectional view of a preferred embodiment of the multilayer nonwoven thermal insulating batt of the present invention..

Preferably, the layered batt is post-treated to stabilize the layered structure. This can be done by heating the surface of the batt, such as by the use of conventional hot air ovens, microwave, or infrared energy sources to bond the perimeters of the layers on the periphery of the batt. This is shown in FIG. 2 where a batt 20 is seen in cross-section with layers 21 remaining individualized in the central portion of batt 20 and being bonded at the periphery 22.

In the Examples which follow, the following test methods were used.

Thickness

Thickness of each batt was determined by applying a 13.8 Pa (0.002 psi) force on the face utilizing a Low Pressure Thickness Gauge Model No. CS-49-46 available from Custom Scientific Instruments Inc.

Density

The volume of a sample of each batt was determined by fixing two planar sample dimensions and measuring the thickness as described above. The density was calculated by dividing the mass of each sample by the volume.

Thermal Resistance

Thermal resistance of the batts was determined according to ASTM-D-1518-85 to determine the combined heat loss due to convection, conduction and radiation mechanisms.

Hand

The hand of each batt was evaluated and ranked on a scale of ranging from poor, fair, good, to excellent.

The following examples further illustrate this invention, but the particular materials, and amounts thereof in these examples, as well as other conditions and details should not be construed to unduly limit this invention. In the examples, all parts and percentages are by weight unless otherwise specified.

Examples 1–6

In Example 1, staple fill fibers (75 weight percent Trevira TM Type 121 polyethylene terephthalate, 1.2 denier, 3.8 cm long, available from Hoechst Celanese Corp.) and bonding fibers (25 weight percent core/sheath fiber prepared according to U.S. Pat. Nos. 4,950,541 and 5,256,050, having a core of polyethylene terephthate surrounded by a sheath of an adhesive polymer of linear low density polyethylene graft copolymer, 2.2 denier, 2.5 cm long) were opened and mixed using a Cromtex TM opener, available from Hergeth Hollingsworth, Inc. The fibers were conveyed to a carding machine that utilized a single doffing roll and a single condensing roll such that the card provided a web having one side on which the fiber are oriented primarily in the machine direction to provide a substantially smooth surface while on the other surface the fibers are oriented in a more vertical direction to provide a loose fibrous character. The web was then passed through an air circulating oven at 218° C. at a rate of 1.68 meters per minute to achieve a stabilized web. The web was then cross-lapped conventionally to a 12-layer batt.

In Example 2, a batt was prepared as in Example 1 except the fiber content was staple fill fibers (55 weight percent Trevira TM Type 121 polyethylene terephthalate, 1.2 denier, 3.8 cm long, available from Hoechst Celanese Corp.) and staple bonding fibers (45 weight percent of the core/sheath fiber used in Example 1).

In Example 3, a batt was prepared as in Example 1 except the fiber content was staple fill fibers (25 weight percent Trevira TM Type 121 polyethylene terephthalate, 1.2 denier, 3.8 cm long, available from Hoechst Celanese Corp.) and staple bonding fibers (75 weight percent of the core/sheath fiber used in Example 1) and the web was crosslapped to form a 12 layer batt.

In Example 4, a batt was prepared as in Example 1 except the fiber content was staple fill fibers (55 weight percent Trevira TM Type 121 polyethylene terephthalate, 1.2 denier, 3.8 cm long, available from Hoechst Celanese Corp.) and staple bonding fibers (45 weight percent of the core/sheath fiber used in Example 1) and the web was crosslapped to form a 5 layer batt.

In Example 5, a batt was prepared as in Example 1 except the fiber content was staple fill fibers (55 weight percent Trevira TM Type 121 polyethylene terephthalate, 1.2 denier, 3.8 cm long, available from Hoechst Celanese Corp.) and staple bonding fibers (45 weight percent of the core/sheath fiber used in Example 1) and the web was crosslapped to form a 20 layer batt.

In Example 6, a batt was prepared as in Example 1 except the fiber content was staple fill fibers (55 weight percent Fortrel TM Type 69460 polyethylene terephthalate, 0.5 denier, 3.8 cm long, available from Wellman Fiber Industries, Florence, S.C.) and staple bonding fibers (45 weight percent of the core/sheath fiber used in Example 1).

In Example 7, a batt was prepared as in Example 1 except the fiber content was staple fill fibers (55 weight percent Trevira TM Type 121 polyethylene terephthalate, 0.85 denier, 3.8 cm long, available from Hoechst Celanese Corp.) and staple bonding fibers (45 weight percent of the core/sheath fiber used in Example 1).

Samples were tested for basis weight, bulk density, thickness, thermal resistance, thermal weight efficiency and hand. The test results are set forth in Table I.

TABLE I

| Example | 1 | 2 | 3 | 4 | 5 | 6 | 7 |
|---|---|---|---|---|---|---|---|
| Fill Fiber (%) | 75 | 55 | 25 | 55 | 55 | 55 | 55 |
| Bonding Fiber (%) | 25 | 45 | 75 | 45 | 45 | 45 | 45 |
| Basis | 233 | 240 | 255 | 101 | 383 | 221 | 250 |

TABLE I-continued

| Example | 1 | 2 | 3 | 4 | 5 | 6 | 7 |
|---|---|---|---|---|---|---|---|
| Weight ($g/m^2$) | | | | | | | |
| Thickness (cm) | 10.6 | 9.5 | 9.8 | 3.7 | 14.4 | 8.2 | 14.9 |
| Bulk Density ($kg/m^3$) | 2.2 | 2.5 | 2.6 | 2.7 | 2.7 | 2.8 | 1.7 |
| Thermal Resistance (clo) | 7.4 | 7.0 | 6.9 | 3.1 | 10.4 | 7.6 | 8.8 |
| Thermal Weight Efficiency ($clo/kg/m^2$) | 31.8 | 29.2 | 23.6 | 30.3 | 27.2 | 30.4 | 35.2 |
| Hand | Excel. | Excel. | Excel. | Excel. | Excel. | Excel. | Excel. |

As can be seen from the data in Table I, in Examples 1, 2 and 3 changing the amount of bonding fiber does not substantially affect the thickness, density or hand, but increasing the amount of the larger denier fill fiber decreases the thermal resistance and the thermal weight efficiency. At higher weights, thickness and thermal resistance increased, the density remained substantially the same and thermal weight efficiency decreased. The substantially constant density demonstrates that the bonding of the webs before layering holds the webs intact in the layers so that the weight of the layers does not compress the batt.

Examples 8–10

In Examples 8–10, batts were prepared as in Example 1 except using staple fill fibers (Trevira TM Type 121 polyethylene terephthalate, 1.2 denier, 3.8 cm long, available from Hoechst Celanese Corp.) and staple bonding fibers (the core/sheath fiber used in Example 1) in the amounts shown in Table II with each batt formed by crosslapping 12 web layers and subsequent to crosslapping the batt was surface bonded with infrared irradiation at 163° C. for 36 minutes. The batts were tested as in examples 1–7. The results are reported in Table II.

TABLE II

| Example | 8 | 9 | 10 |
|---|---|---|---|
| Fill Fiber (%) | 75 | 55 | 25 |
| Bonding Fiber (%) | 25 | 45 | 75 |
| Basis Weight ($g/m^2$) | 215 | 286 | 277 |
| Thickness (cm) | 6.5 | 7.6 | 7.1 |
| Bulk Density ($kg/m^3$) | 3.3 | 3.8 | 3.9 |
| Thermal Resistance (clo) | 5.8 | 6.7 | 6.7 |
| Thermal Weight Efficiency ($clo/kg/m^2$) | 26.7 | 23.5 | 24.3 |
| Hand | Excellent | Excellent | Excellent |

As can be seen from the data in Table II, surface bonding of the batts did also produced batts having excellent thermal resistance and thermal weight efficiency, although varying the amounts of the finer denier fill fibers did not appreciably affect these properties.

Comparative Examples C1–C6

In Comparative Example C1, a batt was prepared as in Example 2 except the web was not bonded prior to cross lapping. In Comparative Examples C2–C6, various commercially available thermal insulating materials were evaluated using the test methods used in Examples 1–6. The materials were as follows: Goose Down 600 available from Company Store, Lacrosse, Wis. (Comparative Example C2); Primaloft TM, available from Albany International Corp., Albany, N.Y. (Comparative Example C3); Comforel TM, available from DuPont Co., Wilmington, Del. (Comparative Example C4); Kod-O-Fil TM, available from Eastman Chemical Co., San Mateo, Calif. (Comparative Example C5); and Thermoloft TM, available from DuPont, Inc. (Comparative Example C6). Test results are set forth in Table III.

TABLE III

| Example | C1 | C2 | C3 | C4 | C5 | C6 |
|---|---|---|---|---|---|---|
| Fill Fiber (%) | 55 | — | — | — | — | — |
| Bonding Fiber (%) | 45 | — | — | — | — | — |
| Basis Weight ($g/m^2$) | 259 | 237 | 308 | 278 | 146 | 324 |
| Thickness (cm) | 6.6 | 6.0 | 3.9 | 3.9 | 2.2 | 3.7 |
| Bulk Density ($kg/m^3$) | 3.9 | 4.0 | 7.8 | 7.2 | 6.6 | 8.8 |
| Thermal Resistance (clo) | 5.8 | 7.4 | 5.3 | 5.5 | 2.3 | 4.4 |
| Thermal Weight Efficiency ($clo/kg/m^2$) | 22.2 | 31.1 | 17.3 | 19.8 | 15.8 | 13.4 |
| Drape Hand | Good | Excellent | Good | Good | Poor | Fair |

As can be seen from the data in Table III, the unbonded batt of Comparative Example C1 had lower thermal resistance and thermal weight efficiency and poorer hand than the similar batt of Example 2. The down sample of Comparative Example C2, had excellent thermal resistance, thermal weight efficiency and hand although it would be expected to exhibit an unpleasant odor when wet typical of down. Comparative Examples C3–C6 exhibited poorer thermal weight efficiency and hand than the down sample or the batts of the invention.

What is claimed is:

1. A nonwoven thermal insulating batt comprising multiple layers of webs, each web comprising 5 to 100 weight percent bonding staple fibers and 0 to 95 weight percent staple fill fibers, said bonding staple fibers being thermally activatable at a temperature below the melt temperature of the staple fill fibers and the bonding fibers bonded to other bonding fibers and fill fibers at the points of contact within each layer to enhance the structural stability of the layers of the batt, said layered batt being further bonded at the perimeter of the layers on the periphery of the batt and the interior portions of the layers not being bonded to adjacent layers.

2. The nonwoven thermal insulating batt of claim 1 wherein said batt contains staple fill fibers of two or more deniers.

3. The nonwoven thermal insulating batt of claim 1 wherein said batt contains staple bonding fibers of two or more deniers.

4. The nonwoven thermal insulating batt of claim 1 wherein said batt has a thermal weight efficiency of at least 20 clo/kg/$m^2$.

5. The nonwoven thermal insulating batt of claim 1 wherein said batt has a bulk density of less than about 0.1 g/$cm^3$.

6. The nonwoven thermal insulating batt of claim 1 wherein said batt has a thickness in the range of about 0.5 to 50 cm.

* * * * *